US008784066B2

(12) United States Patent
Bochiechio et al.

(10) Patent No.: US 8,784,066 B2
(45) Date of Patent: Jul. 22, 2014

(54) DIE CASTING TO PRODUCE A HYBRID COMPONENT

(75) Inventors: Mario P. Bochiechio, Vernon, CT (US); Steven J. Bulliad, Pomfret Center, CT (US); Carl R. Verner, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 917 days.

(21) Appl. No.: 12/940,289

(22) Filed: Nov. 5, 2010

(65) Prior Publication Data

US 2012/0114491 A1 May 10, 2012

(51) Int. Cl.
*F01D 5/14* (2006.01)

(52) U.S. Cl.
USPC ..... 416/241 B; 29/889.71

(58) Field of Classification Search
USPC ..... 416/241 R, 241 B; 29/889.7, 889.71
See application file for complete search history.

(56) References Cited

U.S. PATENT DOCUMENTS

| | | | | |
|---|---|---|---|---|
| 4,464,094 | A | | 8/1984 | Gerken |
| 5,299,353 | A | * | 4/1994 | Nazmy et al. ..... 29/889.7 |
| 5,318,406 | A | * | 6/1994 | Bardes ..... 416/223 A |
| 5,813,832 | A | | 9/1998 | Rasch et al. |
| 5,836,742 | A | | 11/1998 | Dierksmeier et al. |
| 6,468,040 | B1 | | 10/2002 | Grylls et al. |
| 6,709,771 | B2 | | 3/2004 | Allister |
| 7,334,995 | B2 | | 2/2008 | James |
| 2009/0269193 | A1 | | 10/2009 | Larose et al. |

* cited by examiner

*Primary Examiner* — Dwayne J White
(74) *Attorney, Agent, or Firm* — Carlson, Gaskey & Olds, P.C.

(57) ABSTRACT

An example die casting system includes a die that defines a cavity having a first section and a second section. The first section is configured to receive a first portion of a component. The second section is configured to receive a molten material. The die holds the molten material as the molten material solidifies to form a second portion of the component.

13 Claims, 3 Drawing Sheets

DIE CASTING TO PRODUCE A HYBRID COMPONENT

BACKGROUND

This disclosure relates generally to die cast components and, more particularly, to a die casting system for casting a portion of a hybrid component.

Die casting involves injecting molten metal directly into a reusable die. Die casting has typically been used to produce components that do not require high thermal mechanical performance. For example, die casting is commonly used to produce components made from relatively low melting temperature materials that are not exposed to extreme temperatures. Die casting is particularly useful for producing parts having intricate geometries.

Gas turbine engines include multiple components that are subjected to extreme temperatures during operation. For example, the compressor section and turbine section of the gas turbine engine each include blades and vanes having portions that are subjected to relatively extreme temperatures. The blades and vanes are made of specialized materials have been developed to withstand these temperatures. These materials can be costly and heavy.

SUMMARY

An example die casting system includes a die that defines a cavity having a first section and a second section. The first section is configured to receive a first portion of a component. The second section is configured to receive a molten material. The die holds the molten material as the molten material solidifies to form a second portion of the component.

An example component has a first portion and a second portion. The first portion comprises a first material. The second portion comprises a second material that is different than the first material. The first portion, the second portion, or both are die cast within a die. The first portion is secured to the second portion within the die.

An example method of forming a turbomachine component includes holding a first portion of a component within a first section of a cavity and die casting a second portion of the component within a second section of the cavity. The first portion comprises a first material and the second portion comprises a second material that is different than the first material.

The various features and advantages of this disclosure will become apparent to those skilled in the art from the following detailed description. The drawings that accompany the detailed description can be briefly described as follows.

DETAILED DESCRIPTION

Figure 1:
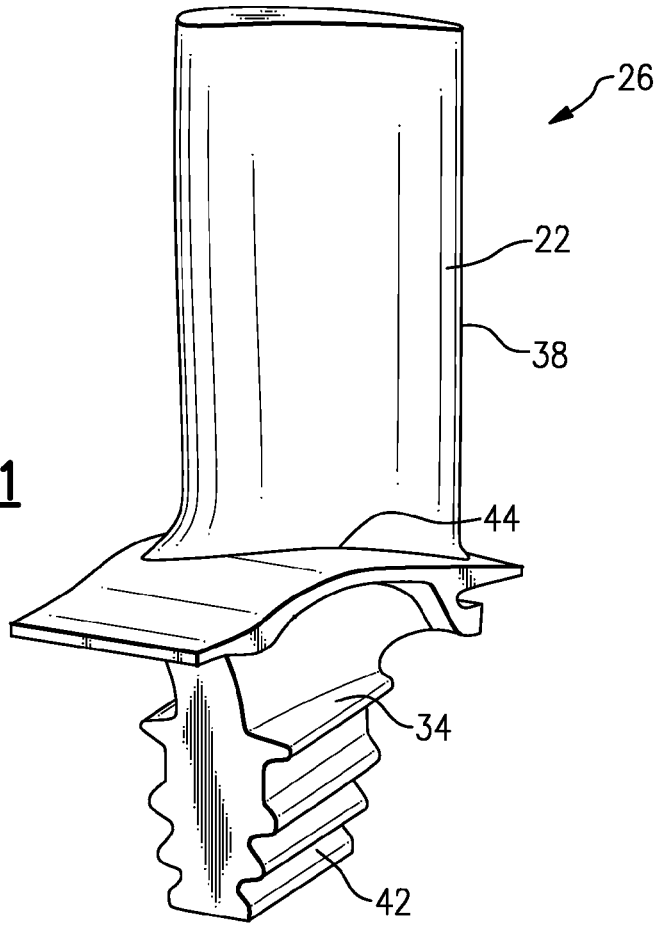
FIG. 1 shows an example hybrid component.
Figure 2:
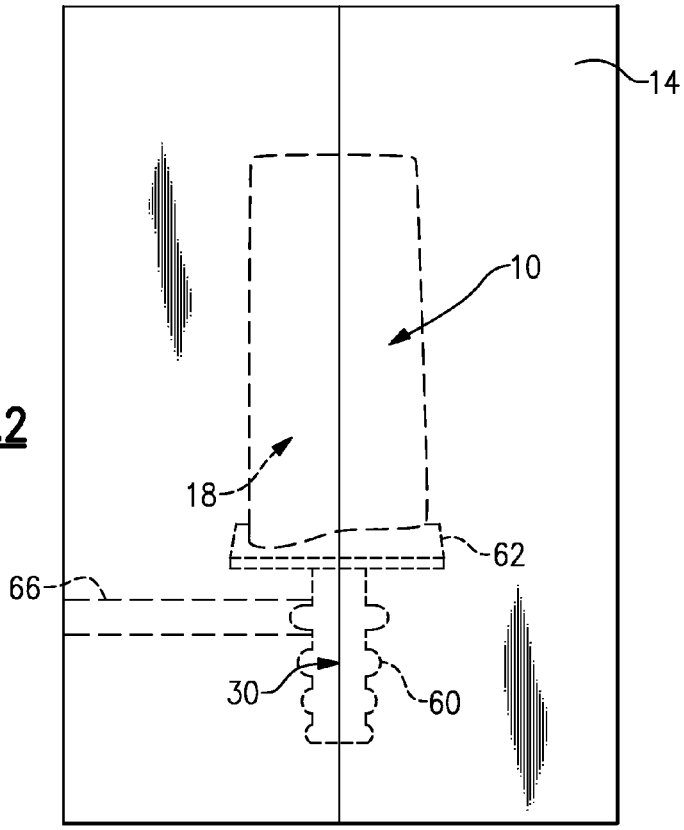
FIG. 2 shows an example die used to cast at least a portion of the FIG. 1 hybrid component.
Figure 3:
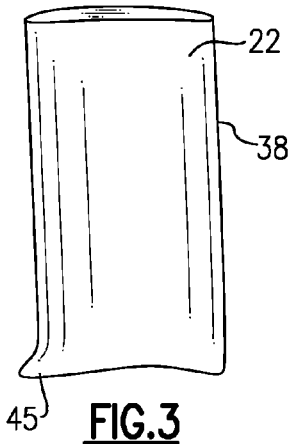
FIG. 3 shows an example portion of the FIG. 1 hybrid component.

Referring to FIGS. 1-3, a cavity 10 is established within an example die 14. A first section 18 of the cavity 10 is configured to receive a first portion 22 of a hybrid component 26. A second section 30 of the cavity 10 is configured to receive a molten material, which solidifies within the cavity 10 to form a second portion 34 of the component 26.

The example component 26 is a blade assembly. The first portion 22 of the component 26 includes an airfoil 38 of the blade assembly. The second portion 34 of the component 26 includes a base 42, or shroud, of the blade assembly. Other examples include other first portions and other second portions. Still other examples include more than two portions.

In this example, the first portion 22 is investment cast and then placed within the cavity 10. In another example, the first portion 22 is die cast in another cavity that is different than the cavity 10. Still other examples may include die casting a first portion within the cavity 10. The first portion 22 could also be a used component that is bonded to a new second portion as part of a repair procedure.

A mechanical bond at an interface 44 secures the first portion 22 of the example component 26 to the second portion 34. In this example, the molten material melts an area 45 of the first portion 22 near the interface 44. The mechanical bond is then formed as the area 45 of the first portion 22 solidifies within the second section 30 of the cavity 10 with the second section 30.

In this example, the material forming the first portion 22 is different than the material forming the second portion 34. The example component 26 is considered a hybrid component because the component 26 comprises more than one type of material.

In one example, the material forming the first portion 22 is a cobalt alloy, and the material forming the second portion 34 is a nickel alloy. In another example, the material forming the first portion 22 is a nickel alloy, and the material forming the second portion 34 is a cobalt alloy. In another example, the material forming the first portion 22 is a cobalt alloy of one composition, and the material forming the second portion 34 is a cobalt alloy of a similar or different composition. In another example, the material forming the first portion 22 is a nickel alloy, and the material forming the second portion 34 is a similar or different nickel alloy. In yet another example, the material forming the first portion 22 is a columnar or single crystal cast directionally solidified material, and the material forming the second portion 34 is a less dense nickel material. In yet another example, the material forming the first portion 22 is a columnar or single crystal cast directionally solidified material, and the material forming the second portion 34 is a cobalt material. The materials selected may be adjusted depending on desired performance, cost, etc.

Figure 4:
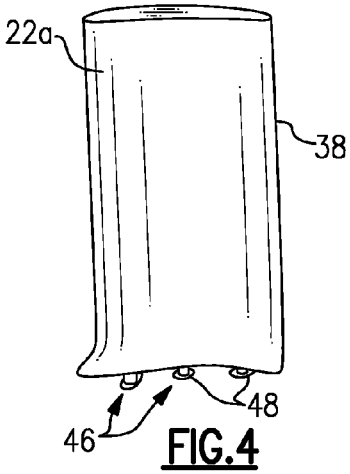
FIG. 4 shows another example portion of another hybrid component.

Referring now to FIG. 4, in another example, a first portion 22*a* is secured relative to a second portion (not shown) by their respective geometries. For example, the first portion 22*a* may include extensions 46 each having an enlarged head 48. In such an example, the molten material of the second portion flows around the extensions 46 as the molten material is moved into the second section 30 of the cavity 10. After solidifying, the extensions 46, and their enlarged heads 48, prevent the first portion 22*a* from moving relative to the second portion.

Figure 4A:
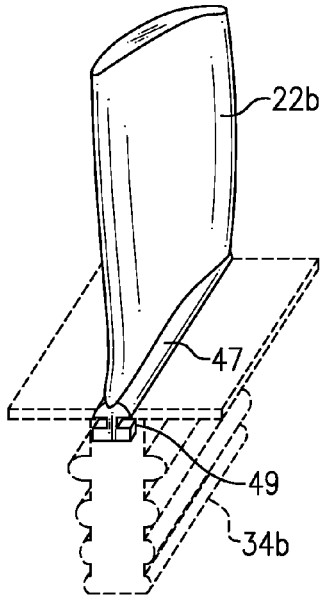
FIG. 4A shows yet another example portion of another hybrid component.

Referring now to FIG. 4A, another example first portion 22*b* includes a rail 47 configured to be slidably received within a groove 49 established in a second portion 34*b*. The second portion 34*b* could also be cast about the rail 47 rather than slidably receiving the rail.

Figure 5:
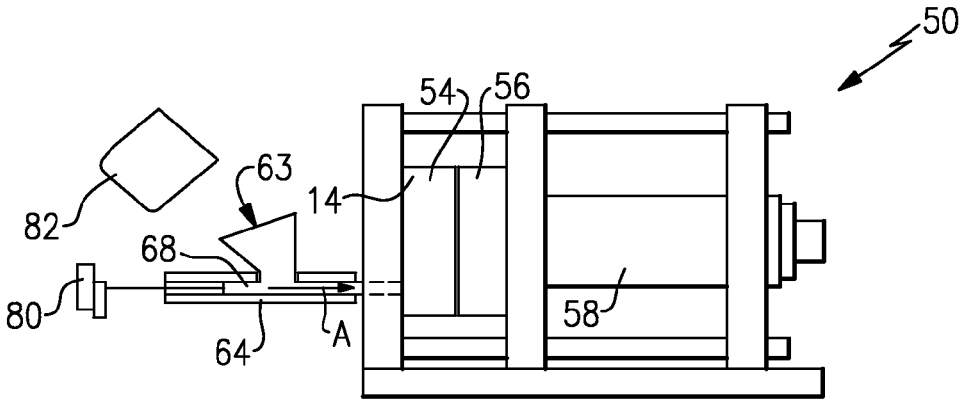
FIG. 5 illustrates an example die casting system used to cast the FIG. 1 hybrid component.

Referring now to FIG. 5 with continued reference to FIG. 1-2, a die casting system 50 includes the die 14 having a plurality of die elements 54, 56 that function to cast the second portion 34 of the component 26. Although two die elements 54, 56 are depicted, it should be understood that the die 14 could include more or fewer die elements, as well as other parts and configurations.

The die 14 is assembled by positioning the die elements 54, 56 together and holding the die elements 54, 56 at a desired positioning via a mechanism 58. The mechanism 58 could include a clamping mechanism of appropriate hydraulic, pneumatic, electromechanical and/or other configurations. The mechanism 58 also separates the die elements 54, 56 subsequent to casting.

The die elements 54, 56 define internal surfaces 62 that cooperate to define a die cavity 60 portion of the cavity 10. A shot tube 64 is in fluid communication with the die cavity 60 via one or more ports 66 located in the die element 54, the die element 56, or both.

A shot tube plunger 68 is received within the shot tube 64 and is moveable between a retracted and injection position (in the direction of arrow A) within the shot tube 64 by a mechanism 80. The mechanism 80 could include a hydraulic assembly or other suitable mechanism, including, but not limited to, pneumatic, electromechanical, or any combination thereof.

The shot tube 64 is positioned to receive a molten metal from a melting unit 82, such as a crucible, for example. The melting unit 82 may utilize any known technique for melting an ingot of metallic material to prepare a molten motel for delivery to the shot tube 64, including but not limited to, vacuum induction melting, electron beam melting and induction skull melting. The molten metal is melted by the melting unit 82 at a location that is separate from the shot tube 64 and the die cavity 60. In this example, the melting unit 82 is positioned in close proximity to the shot tube 64 to reduce the required transfer distance between the molten metal and the shot tube 64.

The molten metal is transferred from the melting unit 82 to the shot tube 64 in a known manner, such as pouring the molten metal into a pour hole 63 in the shot tube 64, for example. A sufficient amount of molten metal is poured into the shot tube 64 to fill the die cavity 60. The shot tube plunger 68 is actuated to inject the molten metal under pressure from the shot tube 64 into the die cavity 60 to cast the component 26. Although the casting of a single portion of the component 26 is depicted, the die casting system 50 could be configured to cast multiple components in a single shot.

The example die casting system 50 depicted in FIG. 5 is illustrative only and could include more or less sections, parts and/or components. This disclosure extends to all forms of die casting, including but not limited to, horizontal or vertical die casting systems.

The example hybrid component 26 is a blade for a turbomachine, such as a turbine blade for a turbine section of a gas turbine engine. However, this disclosure is not limited to the casting of blades. For example, the example die casting system 50 of this disclosure may be utilized to cast aeronautical components including blades, vanes, combustor panels, blade outer air seals, or any other component where performance associated with multiple materials is desired, including non-aeronautical components.

Figure 6A:
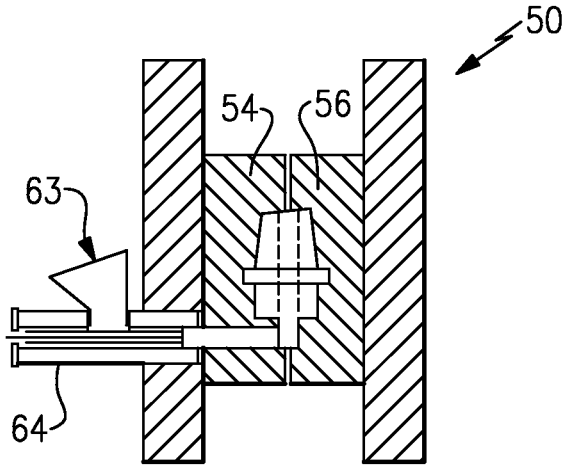
FIG. 6A illustrates the die casting system incorporating the FIG. 2 die during casting of a component.
Figure 6B:
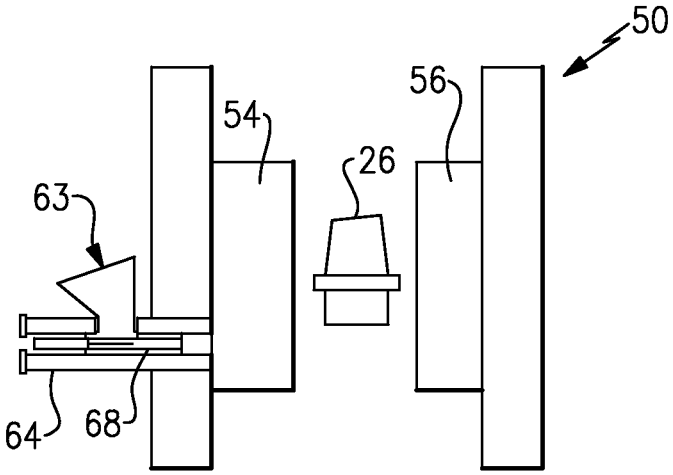
FIG. 6B illustrates the die casting system incorporating the FIG. 2 die upon separation from a die cast component.

FIGS. 6A and 6B illustrate portions of the die casting system 50 during casting (FIG. 6A) and after the die elements 54, 56 separate (FIG. 6B). After the molten metal solidifies within the die cavity 60, the die elements 54, 56 are disassembled relative to the component 26 by opening the die 14 via the mechanism 58.

Features of the disclosed examples include a hybrid component that is at least partially die cast. Die casting a portion of the hybrid component is less expensive and faster than investment casting the entire component. The hybrid component has a blade that is a different material than its base, for example. Another feature is that materials can be selected depending on the desired properties for particular areas of the component.

This same technique can be used to repair or replace a given die cast component. That is, during an overhaul and repair process, the salvageable section of the hardware can be removed and the locking feature can be machined into the retained segment. The section of the component to be repaired can then be die cast onto the existing segment as necessary.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A die casting system, comprising:

a die that defines a cavity having a first section and a second section, the first section configured to receive a first portion of a component, and the second section configured to receive a molten material, wherein the die holds the molten material as the molten material solidifies to form a second portion of the component.

2. The die casting system of claim 1, wherein the component is an aircraft component.

3. The die casting system of claim 1, wherein the component is a gas turbine engine component.

4. The die casting system of claim 1, wherein the component is a blade assembly.

5. The die casting system of claim 4, wherein the first section forms at least a blade portion of the airfoil assembly, and the second section forms at least a shroud portion of the airfoil assembly.

6. The die casting system of claim 1, wherein the first portion of the component comprises a cobalt alloy.

7. The die casting system of claim 6, wherein the second portion of the component comprises a nickel alloy.

8. The die casting system of claim 6, wherein the first portion of the component comprises a metal that is less dense than the second portion of the component.

9. The die casting system of claim 1, wherein the first section is investment cast.

10. The die casting system of claim 1, wherein the molten material held in the second section melts some of the first portion.

11. A method of forming a turbomachine component, comprising holding a first portion of a component within a first section of a cavity; and die casting a second portion of the component within a second section of the cavity, wherein the first portion comprises a first material and the second portion comprises a second material that is different than the first material.

12. The method of claim 11, including melting a least some of the first material using the second material.

13. The method of claim 11, including repairing the component by securing a new second portion to a used first portion.

* * * * *